US011339517B2

(12) United States Patent
Kim et al.

(10) Patent No.: US 11,339,517 B2
(45) Date of Patent: May 24, 2022

(54) LAUNDRY TREATING APPARATUS INCLUDING CONTROL DEVICE AND CONTROL METHOD THEREOF

(71) Applicant: LG Electronics Inc., Seoul (KR)

(72) Inventors: Hyundong Kim, Seoul (KR); Jaehyun Kim, Seoul (KR); Kyungchul Woo, Seoul (KR); Junghoon Lee, Seoul (KR); Myunghun Im, Seoul (KR); Hwanjin Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 16/184,266

(22) Filed: Nov. 8, 2018

(65) Prior Publication Data

US 2019/0136432 A1 May 9, 2019

(30) Foreign Application Priority Data

Nov. 8, 2017 (KR) ..... 10-2017-0148239

(51) Int. Cl.

| | |
|---|---|
| ***D06F 33/32*** | (2020.01) |
| ***D06F 33/72*** | (2020.01) |
| ***D06F 33/70*** | (2020.01) |
| ***D06F 33/36*** | (2020.01) |
| *D06F 37/30* | (2020.01) |
| *D06F 103/00* | (2020.01) |
| *D06F 103/04* | (2020.01) |
| *D06F 105/48* | (2020.01) |

(52) U.S. Cl.

CPC ..... *D06F 33/36* (2020.02); *D06F 37/30* (2013.01); *D06F 2103/00* (2020.02); *D06F 2103/04* (2020.02); *D06F 2105/48* (2020.02)

(58) Field of Classification Search

CPC ..... D06F 33/00; D06F 33/32; D06F 33/50; D06F 33/52; D06F 33/56

See application file for complete search history.

(56) References Cited

U.S. PATENT DOCUMENTS 4,553,413 A 11/1985 Genji et al.
5,241,845 A * 9/1993 Ishibashi ..... G05B 19/042 68/12.02
5,897,672 A * 4/1999 Badami ..... D06F 34/18 8/159

(Continued)

FOREIGN PATENT DOCUMENTS

EP 2405049 1/2012
JP 2014161539 9/2014
WO WO-2006114134 A1 * 11/2006 ..... D06F 34/14

OTHER PUBLICATIONS

Extended European Search Report in European Application No. 18204915.5, dated Mar. 15, 2019, 8 pages.

(Continued)

*Primary Examiner* — Joseph L. Perrin
*Assistant Examiner* — Irina Graf
(74) *Attorney, Agent, or Firm* — Fish & Richardson P.C.

(57) ABSTRACT

A laundry treating apparatus includes a control device that performs a control method to control operation of the laundry treating apparatus. The control device performs test driving of a motor part for driving a washing part, determines control pattern on the basis of a result of the test driving, and controls the motor part in accordance with the control pattern.

19 Claims, 8 Drawing Sheets

(56) References Cited

U.S. PATENT DOCUMENTS

| | | | | |
|---|---|---|---|---|
| 2001/0049590 | A1* | 12/2001 | Wegerich | G06K 9/00536 702/189 |
| 2004/0119434 | A1* | 6/2004 | Dadd | G05B 23/0254 318/490 |
| 2008/0115295 | A1* | 5/2008 | Vadakkeveedu | D06F 13/02 8/159 |
| 2013/0152312 | A1* | 6/2013 | Janke | D06F 33/00 8/137 |
| 2013/0160216 | A1* | 6/2013 | Buendia | D06F 33/00 8/137 |
| 2014/0189959 | A1* | 7/2014 | Dokonal | D06F 33/32 8/137 |
| 2017/0145616 | A1 | 5/2017 | Janke et al. | |

OTHER PUBLICATIONS

Office Action in Korean Appln. No. 10-2017-0148239, dated Dec. 15, 2021, 15 pages (with English translation).

* cited by examiner

FIG. 3

| DRIVING RECORD | DRIVING CONDITION | DRIVING SPEED | DRIVING PATTERN | DRIVING RESULT |
|---|---|---|---|---|
| (a) | a1 | a2 | a3 | a4 |
| (b) | b1 | b2 | b3 | b4 |
| (c) | c1 | c2 | c3 | c4 |
| (d) | d1 | d2 | d3 | d4 |
| (e) | • | • | • | • |
| (f) | • | • | • | • |
| • | • | • | • | • |
| • | • | • | • | • |
| • | • | • | • | • |

LAUNDRY TREATING APPARATUS INCLUDING CONTROL DEVICE AND CONTROL METHOD THEREOF

CROSS-REFERENCE TO RELATED APPLICATION

This application claims the priority benefit of Korean Patent Application No. 10-2017-0148239 on Nov. 8, 2017 in the Korean Intellectual Property Office, the disclosure of which is incorporated herein by reference.

BACKGROUND OF THE INVENTION

1. Field of the Invention

The present invention relates to a laundry treating apparatus and a control method thereof, and more particularly to a control device for controlling a motor part of a laundry treating apparatus, the laundry treating apparatus, and a control method of the laundry treating apparatus.

2. Description of the Related Art

The related art of the present invention is about a technology of controlling a laundry treating apparatus that washes, dries, or dehydrates laundry.

A laundry treating apparatus includes a washing part for accommodating laundry and performing a washing cycle, and a motor part for rotating the washing part, and the laundry treating apparatus rotates the washing part by driving the motor part so as to perform a washing cycle, a drying cycle, a dehydrating cycle, etc. In order to perform a washing cycle in accordance with a status of laundry, the laundry treating apparatus according to the related art includes a means for detecting the status of the laundry loaded in the washing part, and performs the washing cycle in accordance with the detected status of the laundry.

However, such a control technology according to the related art has limitations as follows: the means for detecting a status of laundry is necessarily required due to structural/control constraints, a control method for the washing cycle is limited, and accuracy in determining the washing cycle in accordance with a status of laundry and washing performance of the washing cycle are not ensured.

In order to detect a status of laundry loaded in a washing part, that is, an internal status of the washing part, various and sophisticated detection means are required. For example, a means for detecting a quality of laundry and a means for detecting a quantity of laundry are required. However, these detection means are expensive and delicate sensors, and they may cause economical/structural difficulties in fabricating a laundry treating apparatus.

In addition, since high accuracy in determining a status of laundry is not guaranteed even with such detection means, efficacy and reliability of the detection is not ensured. These problems boil down to a limitation that washing performance of a washing cycle is not ensured.

In conclusion, the technology of controlling a laundry treating apparatus according to the related art has limitations in that provision of a means for detecting a status of laundry is difficult and accordingly it is hard to maximize a washing performance and perform an appropriate washing operation in accordance with a washing condition.

SUMMARY OF THE INVENTION

To improve a limitation of the related art, the present disclosure provides a laundry treating apparatus capable of washing laundry in accordance with a washing condition without an additional detection means, and a control method thereof.

In addition, the present disclosure provides a laundry treating apparatus capable of maximizing a washing performance and performing an appropriate washing operation in accordance with a washing condition, and a control method thereof.

Furthermore, the present disclosure provides a laundry treating apparatus capable of determining and controlling an appropriate control pattern based on accumulated information and reflecting a control result in the accumulated information so as to perform learning control of a motor part, and a control method thereof.

A laundry treating apparatus and a control method thereof disclosed in the present disclosure to achieve the above objects may be implemented as in embodiments of a control device of a laundry treating apparatus, the laundry treating apparatus, and a control method of the laundry treating apparatus.

The control device of the laundry treating apparatus, the laundry treating apparatus, and the control method of the laundry treating apparatus are to perform test driving a motor part for driving a washing part, determine a control pattern on the basis of a result of the test driving, and control the motor part in accordance with the control pattern.

More specifically, a driving waveform in accordance with the test driving may be detected, the control pattern may be determined by comparing the driving wave form with pre-stored driving information, and driving of the motor part may be controlled in accordance with the control pattern.

That is, the control device for the laundry treating apparatus, the laundry treating apparatus, and the control method of the laundry treating apparatus disclosed in the present disclosure may achieve the above-described objects by technical features that the driving waveform in accordance with the test driving is analyzed on the basis of pre-stored data (driving information), and that driving of the motor part is controlled in accordance with the control pattern determined on the basis of a result of the comparison.

The above technical features may be obtained by the control device for controlling the laundry treating apparatus, the laundry treating apparatus, and the control method of the laundry treating apparatus, and embodiments of the control device, the laundry treating apparatus, and the control method are provided.

In accordance with an embodiment of the present invention, the above and other objects can be accomplished by the provision of a control device of a laundry treating apparatus which includes a washing part for performing a washing cycle with respect to loaded laundry, and a motor part for driving the washing part in accordance with the washing cycle, the control device including: a storage module configured to store driving information including driving conditions, driving speeds, driving patterns, driving waveforms, and driving results according to driving records of the motor part; and a control module configured to perform test driving of the motor part before the washing cycle, detect a driving waveform of the motor part in accordance with the test driving, determine a control pattern ensuring a maximum performance of the washing cycle by comparing the driving information pre-stored in the storage module and the drive waveform, and control the motor part in accordance with the control pattern.

The test driving may be driving the motor part in a predetermined driving pattern.

The control pattern may be a pattern for controlling a change in one or more of a driving speed, a driving direction, and a driving time of the motor part in accordance with the washing cycle.

The control module may be further configured to determine the control pattern by comparing a plurality of waveforms included in the driving information and the driving waveform.

The control module may be further configured to: measure a similarity between each of the plurality of waveforms and the driving waveform by comparing the plurality of waveforms and the driving waveform; detect a waveform having a similarity equal to or greater than a preset reference similarity with respect to the driving waveform from among the plurality of waveforms; and determine the detected similar waveform as the control pattern.

The control module may be further configured to, when the similar waveform are a plurality of waveforms, determine a driving pattern corresponding to a waveform having a highest driving result from among the plurality of waveforms as the control pattern.

The control module may be further configured to determine the control pattern by analyzing a washing condition for the laundry on the basis of a driving condition and a driving result corresponding to the similar waveform.

The washing condition may be a condition relating to one or more of a quantity and a quality of the laundry.

The control module may be further configured to: further configured to: determine one or more patterns in accordance with the washing condition on the basis of the driving condition; on the basis of the driving result, determine a pattern ensuring a maximum performance of the washing cycle from among the one or more patterns; and determine the determined pattern as the control pattern.

The control module may be further configured to: divide the driving waveform into a plurality of sections and compare the plurality of sections with the plurality of waveforms; detect a waveform having a similarity equal to or greater than the reference similarity with respect to the plurality of sections from among the plurality of waveforms; and determine the control pattern on the basis of the detected similar waveform.

The control module may be further configured to update the driving information by analyzing a control result of the motor part in accordance with the control pattern and storing an analysis result in the driving information.

The analysis result may include a driving condition, a driving speed, a driving pattern, a driving waveform, and a driving result of the motor part in accordance with the control pattern.

In addition, to achieve the above-described objects, there is provided a laundry treating apparatus including: a washing part configured to perform a washing cycle with respect to laundry loaded therein; a motor part configured to drive the washing part in accordance with the washing cycle; and a controller configured to store driving information including information on driving conditions, driving speeds, driving waveforms, and driving results according to driving records of the motor part, and drive the motor part in accordance with the washing cycle, wherein the controller is further configured to perform test driving of the motor part before the washing cycle, detect a driving waveform of the motor part in accordance with the test driving, determine a control pattern in which the washing cycle is performed with maximum performance on the basis of a result of comparison between the pre-stored driving information and the drive waveform, and control the motor part in accordance with the control pattern.

The test driving may be driving the motor part in a predetermined driving pattern.

The controller may be a pattern for controlling a change in one or more of a driving speed, a driving direction, and a driving time of the motor part in accordance with the washing cycle.

The controller may be further configured to determine the control pattern by comparing a plurality of waveforms included in the driving information and the driving waveform.

The controller may be further configured to: measure a similarity between each of the plurality of waveforms and the driving waveform by comparing the plurality of waveforms and the driving waveform; detect a waveform having a similarity equal to or greater than a preset reference similarity with respect to the driving waveform from among the plurality of waveforms; and determine the detected similar waveform as the control pattern.

The controller may be further configured to, when the similar waveform are a plurality of waveforms, determine a driving pattern corresponding to a waveform having a highest driving result from among the plurality of waveforms as the control pattern.

The controller may be further configured to determine the control pattern by analyzing a washing condition for the laundry on the basis of a driving condition and a driving result corresponding to the similar waveform.

The washing condition may be a condition relating to one or more of a quantity and a quality of the laundry.

The control module may be further configured to: determine one or more patterns in accordance with the washing condition on the basis of the driving condition; on the basis of the driving result, determine a pattern ensuring a maximum performance of the washing cycle from among the one or more patterns; and determine the determined pattern as the control pattern.

The controller may be further configured to: divide the driving waveform into a plurality of sections and compare the plurality of sections with the plurality of waveforms; detect a waveform having a similarity equal to or greater than the reference similarity with respect to the plurality of sections from among the plurality of waveforms; and determine the control pattern on the basis of the detected similar waveform.

The controller may be further configured to update the driving information by analyzing a control result of the motor part in accordance with the control pattern and storing an analysis result in the driving information.

The analysis result may include a driving condition, a driving speed, a driving pattern, a driving waveform, and a driving result of the motor part in accordance with the control pattern.

In order to achieve the above objects, there is provided a control method of a laundry treating apparatus which includes a washing part for performing a washing cycle with respect to loaded laundry, and a motor part for driving the washing part in accordance with the washing cycle, the method including: detecting a driving waveform by performing test driving of the motor part; determining a control pattern for controlling the motor part by comparing pre-stored driving information and the driving waveform; and performing the washing cycle by controlling the motor part in accordance with the control pattern, wherein the driving information comprises information on driving conditions, driving speeds, driving patterns, driving waveforms, and driving results according to a driving records of the motor part.

The detecting of the driving waveform may include performing test driving of the motor part in a preset driving pattern.

The control pattern may be a pattern for controlling a change in one or more of a driving speed, a driving direction, and a driving time of the motor part in accordance with the washing cycle.

The determining of the control pattern may include: comparing a plurality of waveforms included in the driving information and the driving waveform; measuring a similarity between each of the plurality of waveforms and the driving waveform; detecting a waveform having a similarity equal to or greater than a preset reference similarity with respect to the driving waveform from among the plurality of waveforms; and determining the control pattern on the basis of the detected similar pattern.

The determining of the control pattern may include, when the similar waveform are a plurality of waveforms, determining a driving pattern corresponding to a waveform having a highest driving result from among the plurality of waveforms as the control pattern.

The determining of the control pattern may include determining the control pattern by analyzing a washing condition for the laundry on the basis of a driving condition and a driving result corresponding to the similar waveform.

The washing condition may be a condition relating to one or more of a quantity and a quality of the laundry.

The determining of the control pattern comprises: determine one or more patterns in accordance with the washing condition on the basis of the driving condition; on the basis of the driving result, determine a pattern ensuring a maximum performance of the washing cycle from among the one or more patterns; and determine the determined pattern as the control pattern.

The determining of the control pattern may include: dividing the driving waveform into a plurality of sections and compare the plurality of sections with the plurality of waveforms; detecting a waveform having a similarity equal to or greater than the reference similarity with respect to the plurality of sections from among the plurality of waveforms; and determining the control pattern on the basis of the detected similar waveform.

The control method may further include: updating the driving information by analyzing a control result of the motor part in accordance with the control pattern and storing an analysis result in the driving information.

The analysis information may include a driving condition, a driving speed, a driving pattern, a driving waveform, and a driving result of the motor part in accordance with the control pattern.

The control device of the laundry treating apparatus, the laundry treating apparatus, and the control method of the laundry treating apparatus disclosed in the present disclosure are characterized in that test driving of a motor part for driving a washing part is performed, a control pattern is performed on the basis of a result of the test driving, and the motor part is controlled in accordance with the control pattern, and thus, there are advantages in that a washing condition may be determined without an additional detection means and a washing cycle may be performed in accordance with the washing condition.

In addition, the control device of the laundry treating apparatus, the laundry treating apparatus, and the control method of the laundry treating apparatus disclosed in the present disclosure are characterized in that the driving waveform in accordance with the test driving is analyzed on the basis of pre-stored data (driving information) and driving of the motor part is controlled in the control pattern determined on the basis of the analysis, and thus, there are advantages in that an appropriate control pattern may be determined and controlled based on accumulated information and learning control may be performed such that a control result is reflected.

Accordingly, the control device of the laundry treating apparatus, the laundry treating apparatus, and the control method of the laundry treating apparatus disclosed in the present disclosure are characterized in that a washing condition is determined and a washing cycle is performed in accordance with the washing condition, and thus, there are advantages in that a washing performance may be maximized, an appropriate washing operation may be performed in accordance with the washing condition, and the washing performance may be enhanced in proportion to the number of times the washing cycle is performed.

Furthermore, the control device of the laundry treating apparatus, the laundry treating apparatus, and the control method of the laundry treating apparatus disclosed in the present disclosure are characterized in that washing performance is enhanced in proportion to the number of times a washing cycle is performed, and thus, there are advantages in that the washing performance may be easily enhanced and maintained and reliability of the washing cycle may improve.

BRIEF DESCRIPTION OF THE DRAWINGS

The above and other objects, features and other advantages of the present invention will be more clearly understood from the following detailed description taken in conjunction with the accompanying drawings, in which:

FIG. 3 is a diagram illustrating an example of driving records included in driving information according to an embodiment of a control device of a laundry treating apparatus disclosed in the present disclosure.

DETAILED DESCRIPTION OF THE PREFERRED EMBODIMENTS

Figure 1:
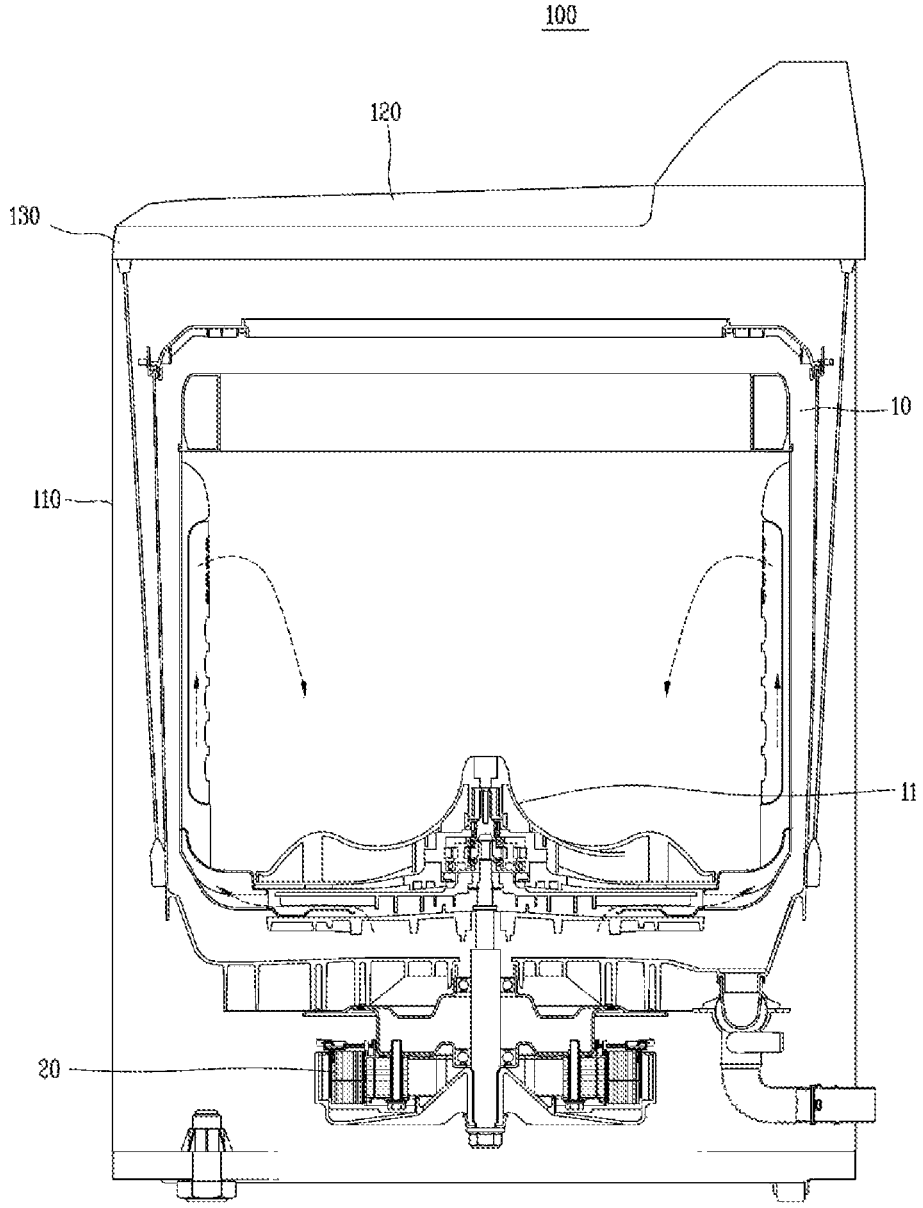
FIG. 1 is a diagram illustrating a general structure of a laundry treating apparatus disclosed in the present disclosure.

Advantages and features of the present invention and methods for achieving them will be made clear from the embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The present invention is defined only by the scope of the claims. Like reference numerals refer to like elements throughout the specification.

A laundry treating apparatus and a control method thereof disclosed in the present disclosure may be applied to a laundry treating apparatus for washing, drying, and dehydrating laundry, a control device for controlling the laundry treating apparatus, a control device included in the laundry treating apparatus, a control method for controlling the laundry treating apparatus, and a control method for controlling a control device that controls the laundry treating apparatus. In particular, the present invention may be effectively applied to a control device for controlling a motor part of a laundry treating apparatus, a control method thereof, and a control system thereof.

However, technologies disclosed in the present disclosure are not limited thereto, and may be applicable to any laundry treating apparatus to which the technical concept of the technologies is applicable, a control device of the laundry treating apparatus, a control system of the laundry treating apparatus, and a control method of the laundry treating apparatus, and the use of the technologies is not limited but instead varies.

It should be noted that technical terms used in the present disclosure are used only to describe a specific exemplary embodiment, and do not intend to limit the present disclosure. Further, technical terms used in the present disclosure shall be construed as a meaning generally understood by those skilled in the art unless they are specially defined as other meanings in the present disclosure, and shall not be construed in excessively general or narrow meanings.

Further, when technical terms used in the present disclosure are improper technical terms, which fail to correctly express the spirit of the present disclosure, the technical terms shall be substituted with technical terms, which those skilled in the art may properly understand, to be understood. Further, a general term used in the present disclosure shall be construed according to a meaning defined in a dictionary or the context of a related description, and shall not be construed to have an excessively narrow meaning.

Further, the singular forms used in the present disclosure include the plural forms, unless the context clearly indicates otherwise. In the present disclosure, a term, "comprise" or "include" shall not be construed as essentially including several constituent elements or several steps described in the specification, and it shall be construed that some constituent elements or some steps may not be included, or additional constituent elements or steps may be further included.

Hereinafter, an exemplary embodiment of the present disclosure will be described in detail with reference to the accompanying drawings, in which like reference numerals refer to like or similar constituent elements regardless of reference numerals and a duplicated description thereof will be omitted.

In describing the present disclosure, when it is determined that the detailed description of the known art related to the present disclosure may obscure the gist of the present disclosure, the detailed description thereof will be omitted. Further, it is noted that the accompanying drawings are used just for easily appreciating the spirit of the present disclosure and it should not be analyzed that the spirit of the present disclosure is limited by the accompanying drawings.

Hereinafter, a control device of a laundry treating apparatus, the laundry treating apparatus, and a control method of the laundry treating apparatus disclosed in the present disclosure will be described with reference to FIGS. 1 to 10.

FIG. 1 is a diagram illustrating a general structure of a laundry treating apparatus disclosed in the present disclosure.

Figure 2:
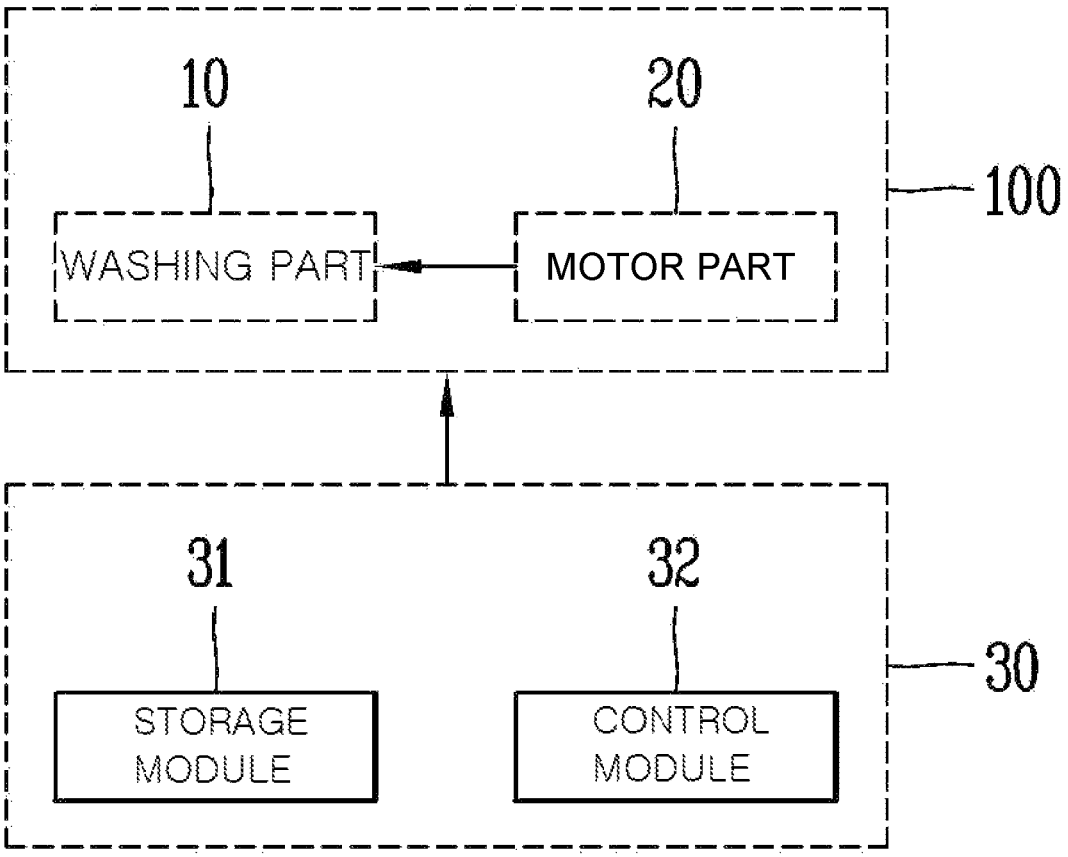
FIG. 2 is a diagram illustrating configurations of a control device of a laundry treating apparatus disclosed in the present disclosure.

FIG. 2 is a diagram illustrating configurations of a control device of a laundry treating apparatus disclosed in the present disclosure.

FIG. 3 is a diagram illustrating an example of driving records included in driving information according to an embodiment of a control device of a laundry treating apparatus disclosed in the present disclosure.

Figure 4:
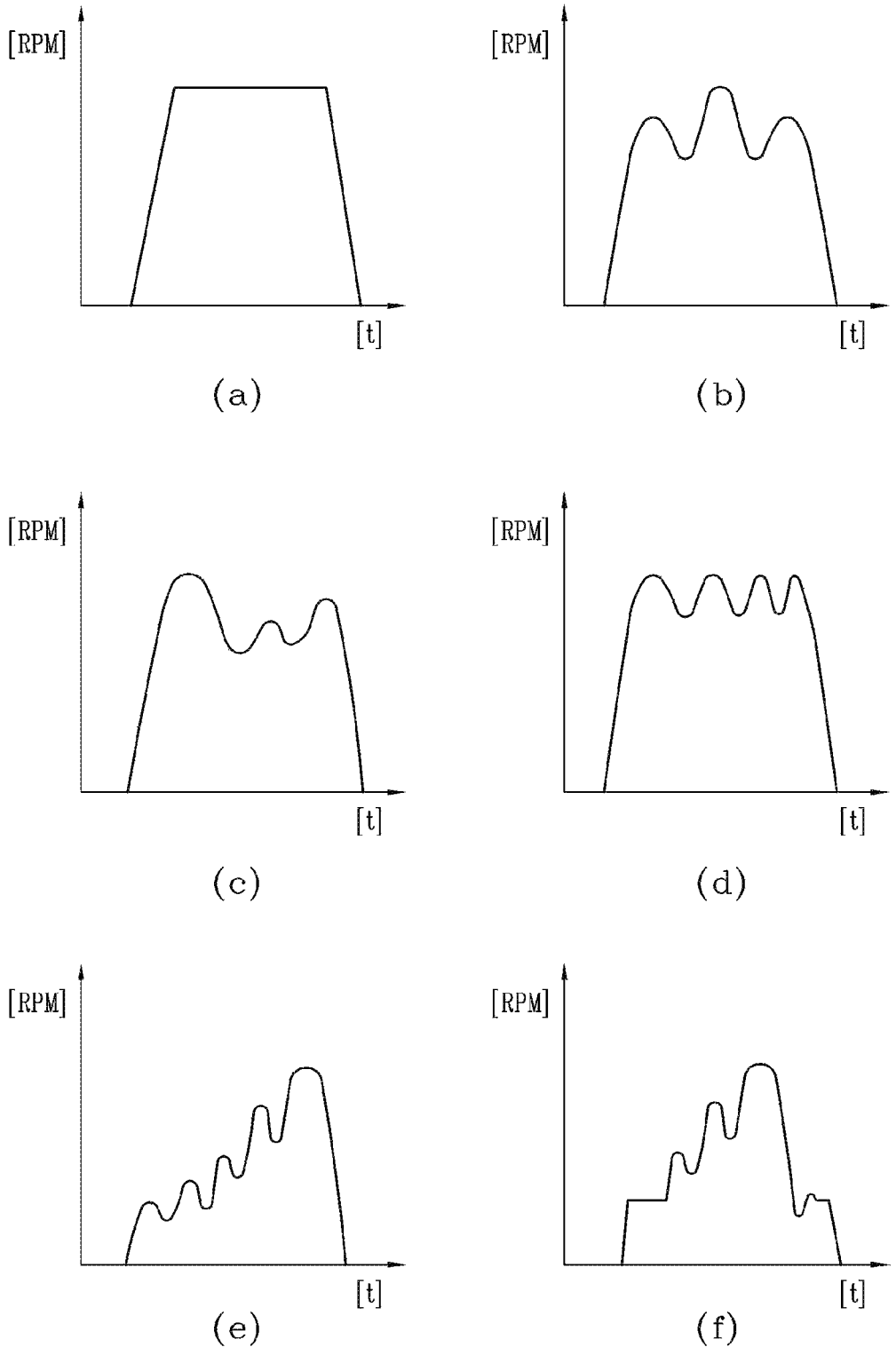
FIG. 4 is a diagram illustrating examples of driving waveforms included in driving information according to an embodiment of a control device of a laundry treating apparatus disclosed in the present disclosure.

FIG. 4 is a diagram illustrating examples of driving waveforms included in driving information according to an embodiment of a control device of a laundry treating apparatus disclosed in the present disclosure.

Figure 5:
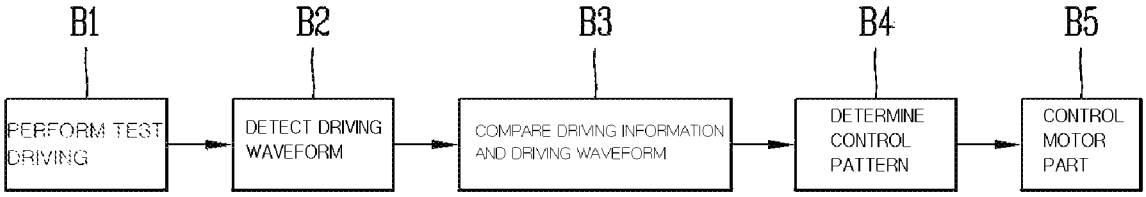
FIG. 5 is a block diagram illustrating a control procedure according to an embodiment of a control device of a laundry treating apparatus disclosed in the present disclosure.

FIG. 5 is a block diagram illustrating a control procedure according to an embodiment of a control device of a laundry treating apparatus disclosed in the present disclosure.

Figure 6:
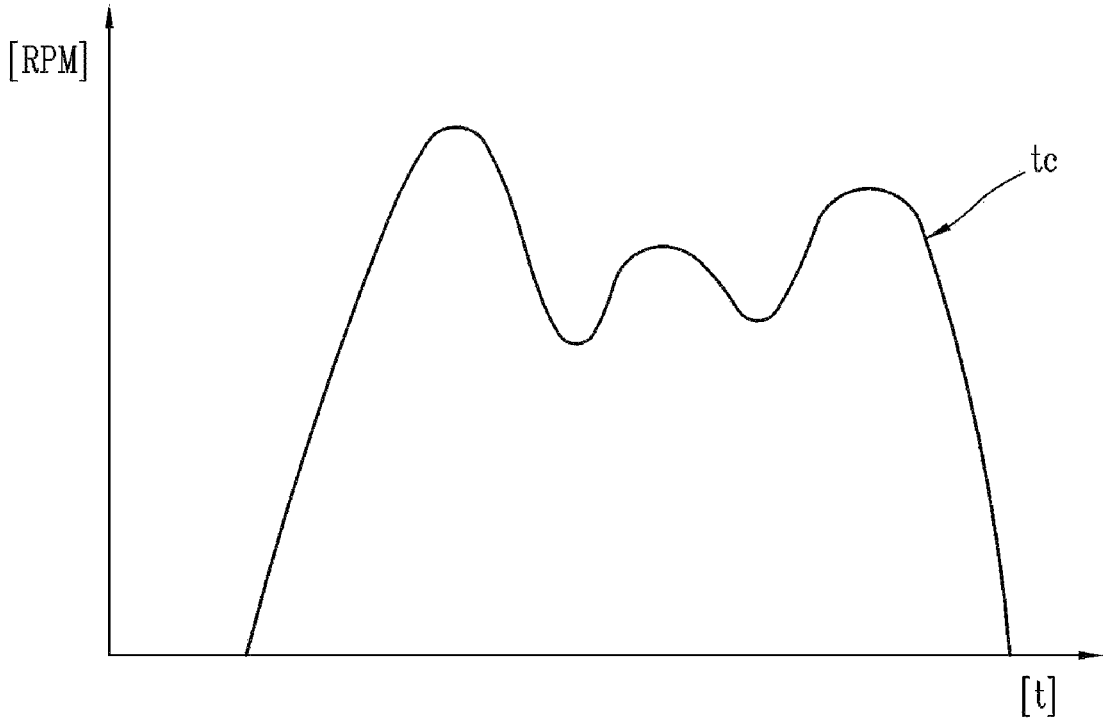
FIG. 6 is a diagram illustrating an example of a driving waveform according to an embodiment of a control device of a laundry treating apparatus disclosed in the present disclosure.

FIG. 6 is a diagram illustrating an example of a driving waveform according to an embodiment of a control device of a laundry treating apparatus disclosed in the present disclosure.

Figure 7:
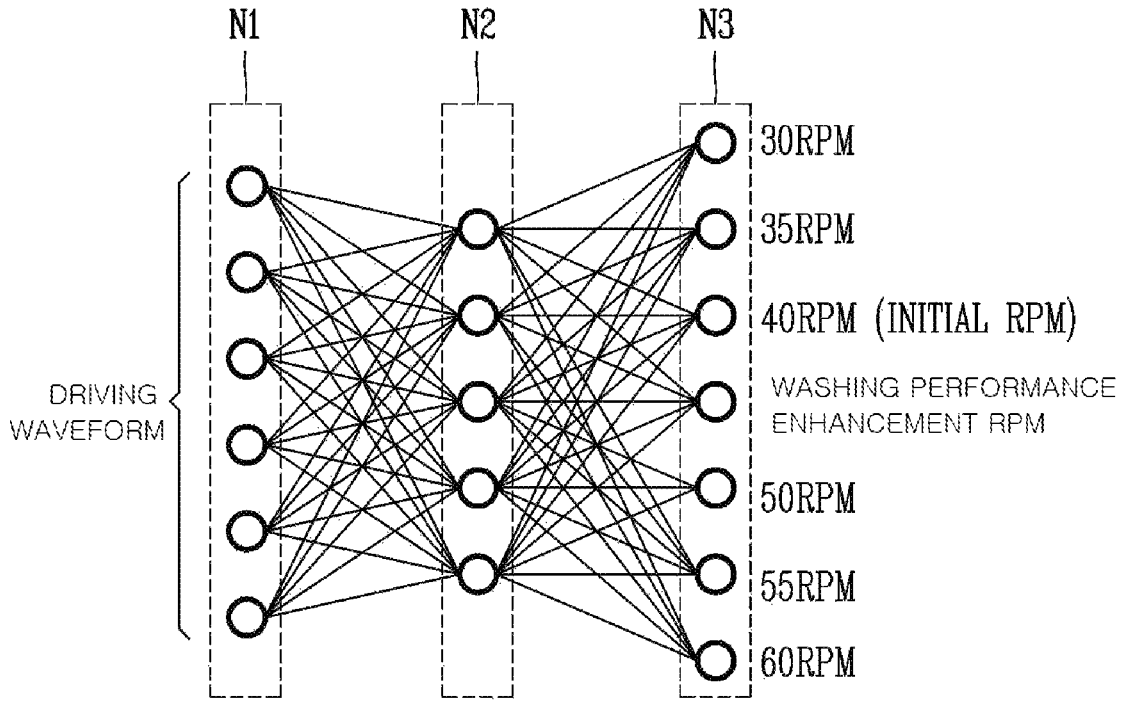
FIG. 7 is a conceptual diagram illustrating determination of a control pattern according to an embodiment of a control device of a laundry treating apparatus disclosed in the present disclosure.

FIG. 7 is a conceptual diagram illustrating determination of a control pattern according to an embodiment of a control device of a laundry treating apparatus disclosed in the present disclosure.

Figure 8:
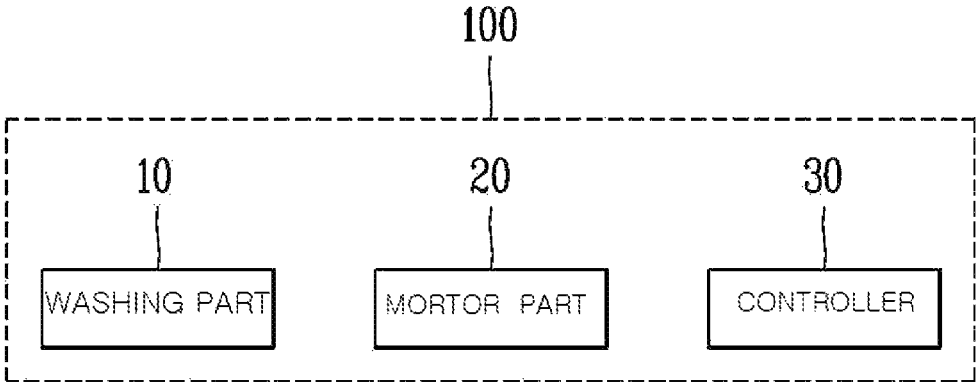
FIG. 8 is a diagram illustrating configurations of a laundry treating apparatus disclosed in the present disclosure.

FIG. 8 is a diagram illustrating configurations of a laundry treating apparatus disclosed in the present disclosure.

Figure 9:
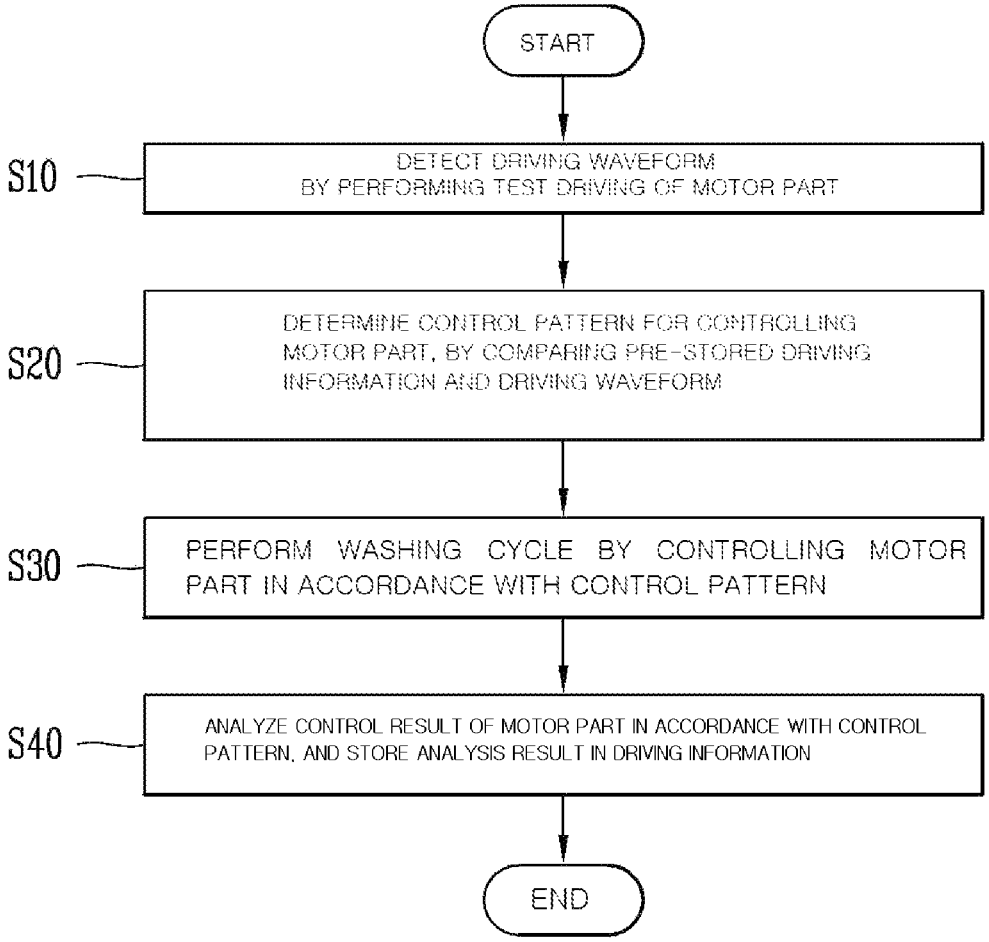
FIG. 9 is a flowchart illustrating a control method of a laundry treating apparatus disclosed in the present disclosure.

FIG. 9 is a flowchart illustrating a control method of a laundry treating apparatus disclosed in the present disclosure.

Figure 10:
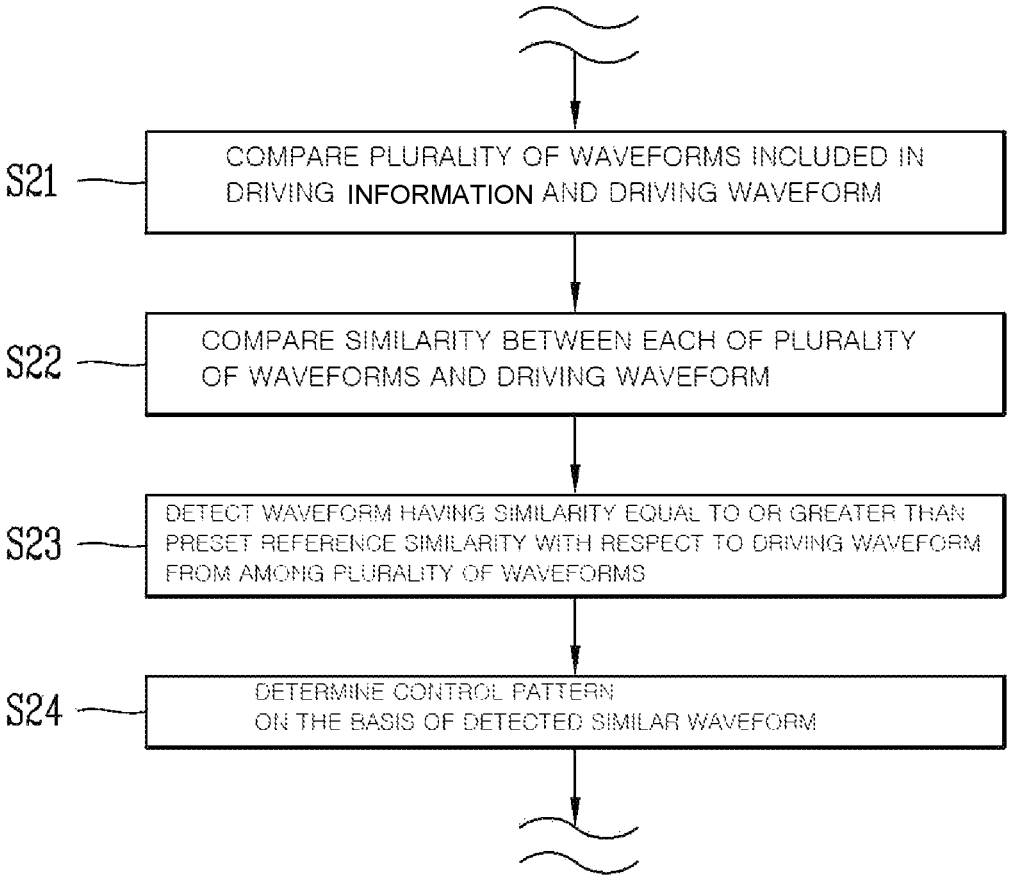
FIG. 10 is a flowchart illustrating a control method of a laundry treating apparatus disclosed in the present disclosure.

FIG. 10 is a flowchart illustrating a control method of a laundry treating apparatus disclosed in the present disclosure.

First, referring to FIG. 1, a general structure of a control device of a laundry treating apparatus, the laundry treating apparatus, and a control method of the laundry treating apparatus disclosed in the present disclosure will be described.

The laundry treating apparatus is an apparatus for washing, drying, or dehydrating laundry and may be in a structure as illustrated in FIG. 1.

As illustrated in FIG. 1, a laundry treating apparatus 100 may include a cabinet 110 forming an outer appearance, a top cover 130 seated on the top of the cabinet 110, and a door 120 seated on the top of the top cover 130 to open and close a tub.

A control panel (not illustrated) for controlling an operation status of the laundry treating apparatus is mounted on one side of the top cover 130, and a detergent box (not illustrated) is inserted into an inner inclined surface of the top cover 130.

In addition, the laundry treating apparatus 100 includes a reservoir (not illustrated) accommodated in the cabinet 110, a washing part 10 accommodated in the reservoir to wash laundry while rotating, a motor part 20 for driving the washing part 10 to rotate, and an impurity collecting device mounted on one inner side of the washing part 10.

More specifically, a pulsator 11 for stir wash water is mounted at a bottom surface of the washing part 10.

Operation of the laundry treating apparatus 100 in the above structure may be performed as follows.

First, when laundry is loaded into the washing part 10 and then power is applied to the laundry treating apparatus 100, a washing condition may be input by pressing washing course selection buttons provided on the control panel.

When a washing operation starts in response to pressure of an operation button, a wash water flows into the washing part 10. When the level of the wash water reaches a preset level, the pulsator 11 rotates and thereby the washing operation starts.

Here, due to the rotation of the pulsator 11, the laundry is mixed and specific water currents are formed in the wash water. Specifically, since the pulsator 11 rotates, a centrifugal force is applied to the wash water. Thus, the wash water is pushed toward an inner wall of the washing part 10 and performs circular motion along the inner wall of the washing part 10.

In addition, as the pulsator 11 and the washing part 10 changes the direction of rotation at a predetermined interval of time, the wash water in the washing part changes in its direction of rotation and thus is mixed.

As the wash water flows into and out of the impurity collecting device, impurities such as lint and the like may be filtered out in the foreign substance collecting device.

A drain pump (not illustrated) for draining wash water accommodated in the washing part 10 may be provided under the washing part 10.

In addition, a circulation pump (not illustrated) for causing wash water accommodated in the washing part 10 to flow to an upper area of the washing part 10 may be provided under the washing part 10.

Meanwhile, the washing part 10 may include a detection unit (not illustrated) for detecting a level of wash water accommodated in the washing part 10.

In addition, the laundry treating apparatus 100 may include a communication unit (not illustrated) capable of communicating with an external network.

The above-described laundry treating apparatus 100 may perform a washing cycle, a dehydrating cycle, a drying cycle, a water-supply cycle, and a drainage cycle. In addition, in order to perform a series of cycles, the laundry treating apparatus 100 may supply wash water to the inside of the washing part 10 or drain wash water from the washing part 10.

A controller (or control device) (not illustrated) of the laundry treating apparatus 100 may control operation of the laundry treating apparatus 100 so that the laundry treating apparatus 100 performs a series of cycles.

Hereinafter, a control device of a laundry treating apparatus disclosed in the present disclosure will be described with reference to FIGS. 2 to 7.

A control device of a laundry treating apparatus disclosed in the present disclosure (hereinafter, referred to as a control device) refers to a device for controlling the above-described laundry treating apparatus.

The control device may be a Central Processing Unit (CPU), a minicontroller (micom), or a controller that is included in the laundry treating apparatus to control operation of the laundry treating apparatus.

Here, the control device may control operation of each component included in the laundry treating apparatus, such as a washing cycle of the laundry treating apparatus.

The control device may be in the form of a control module including a plurality of circuit elements.

As illustrated in FIG. 2, a control device 30 may control the laundry treating apparatus 100 including: the washing part which performs a washing cycle with respected to laundry loaded therein; and the motor part 20 which drives the washing part 10 in response to the washing cycle.

The control device 30 may be a control device that is included in the laundry treating apparatus 100 to control the laundry treating apparatus 100.

The control device 30 may control the washing cycle of the laundry treating apparatus 100 by controlling driving of the motor part 20 that drives the washing part 10.

By controlling a driving speed or pattern of the motor part 20 so as to control operation of the washing part 10, the control device 30 may control the washing cycle.

The control device 30 includes a storage module 31 and a control module 32 to control the laundry treating apparatus 100 which includes the washing part 10 and the motor part 20.

The storage module 31 may be a storage means for storing data related to controlling of the laundry treating apparatus 100, and may be, for example, a memory element.

The storage module 31 may store data processed by the control module 32.

The control module 32 may be a computation means (or processing means) for processing data related to controlling of the laundry treating apparatus 100, and may be, for example, a Central Processing Unit (CPU).

The control module 32 may include a program embedded therein, the program for controlling driving of the motor part 20, and compute/process data on driving control of the motor part 20 and store the computed/processed data in the storage module 31.

The control module 32 may control operation of the laundry treating apparatus 100 by driving the motor part 20 in accordance with the washing cycle.

The control module 32 may drive the motor part 20 so that the washing cycle is performed in accordance with a status of the laundry loaded in the washing part 10, that is, a laundry status.

The storage module 31 in the control device 30 stores driving information including information on driving conditions, driving speeds, driving patterns, driving waveforms, and driving results according to driving records of the motor part 20. The control module 32 in the control device performs test driving of the motor part 20 before the washing cycle, detects a driving waveform of the motor part 20 in the test driving, determines, based on a result of comparison between the driving information pre-stored in the storage module 31 and the detected driving waveform, a control pattern ensuring a maximum performance of the washing cycle, and controls the motor part 20 in accordance with the control pattern.

The driving information may be information (data) about accumulated and stored previous driving records of the motor part 20.

The driving information may be driving records in accordance with previous washing cycles of the motor part 20, which is stored in a table format.

For example, as illustrated in FIG. 3, the driving information may include previous driving records a to f of the motor part 20, and may include a driving condition, a driving speed, a driving pattern, and a driving result corresponding to each of the driving records a to f. As illustrated in FIG. 4, the driving information may include waveforms a to f of the motor part 20 depending on a driving speed and a driving pattern.

Here, the driving condition may mean a condition of the washing cycle.

The condition of the washing cycle may be a status of the laundry loaded in the washing part 10, that is, a laundry status condition.

The driving speed may be a driving speed of the motor part 20 in accordance with the washing cycle.

The driving pattern may be a pattern in which driving of the motor part 20 is changed during the washing cycle.

That is, the driving pattern may be a pattern in which the driving speed is changed while the motor part 20 is driven.

The driving pattern may be represented by the driving waveform as illustrated in FIG. 4.

The driving result may be a performance result of the washing cycle in accordance with the driving pattern.

The driving result may be a result of assessment obtained by reflecting one or more of the following: power which the laundry treating apparatus 100 has consumed during the washing cycle; a period of time in which the washing cycle has been performed; an amount of water which has been consumed during the washing cycle; and a degree of washing of the laundry in accordance with the washing cycle.

The driving information including the driving conditions, the speeds, the patterns, the waveforms, and the result information, as illustrated in FIGS. 3 and 4, may be processed into data by the control module 32 while the control module 32 performs the washing cycle, and may be then stored in the storage module 31.

When the laundry is loaded into the washing part 10, the control module 32 may control driving of the motor part 20 so as to perform the washing cycle in accordance with the status of the laundry loaded in the washing part.

Control of the motor part 20 by the control module 32 may be performed in an order illustrated in FIG. 5.

As illustrated in FIG. 5, the control module 32 may perform test driving of the motor part 20 before the washing cycle (B1), detect a driving waveform of the motor part 20 in accordance with the test driving (B2), compare the driving information pre-stored in the storage module 31 and the driving waveform (B3), determine, based on a result of the comparison and the analysis, a control pattern ensuring a maximum performance of the washing cycle (B4), and control the motor part 20 in accordance with the control pattern (B5).

The test driving may be test driving for detecting and determining a status of the laundry before the washing cycle.

The test driving may be test driving of the motor part 20 in a preset driving pattern.

The test driving may be test driving for detecting and determining a status of the laundry based on a result of driving the motor part 20, determining a control pattern based on the detection and the determination, and controlling the motor part 20 in accordance with the control pattern.

The control pattern may be a control pattern of the motor part 20 for performing the washing cycle in accordance with the status of the laundry.

The control pattern may be a pattern for controlling a change in one or more of a driving speed, a driving direction, and a driving time of the motor part 20 in accordance with the washing cycle.

That is, the control module 32 may control driving of the motor part 20 in accordance with the control pattern that is determined as a result of the test driving.

The control module 32 may perform test driving of the motor part 20 in the preset driving pattern (B1), and detect the driving waveform in accordance with the test driving (B2).

The control module 32 may perform test driving of the motor part 20, detect a change in the speed of the motor part 20, and detect the driving waveform in accordance with the test driving.

The driving waveform tc is a waveform in accordance with a change in a driving speed and a driving pattern of the motor part 20, and may be the same as illustrated in FIG. 6.

The control module 32 may detect the driving waveform tc (B2), as illustrated in FIG. 6, and compare the driving information pre-stored in the storage module and the driving waveform tc (B3).

The control module 32 may determine the control pattern by comparing a plurality of waveforms included in the driving information and the driving waveform tc.

In other words, the control module 32 may compare the plurality of waveforms included in the driving information as illustrated in FIG. 4 and the driving form tc detected as a result of the test driving.

The control module 32 may measure a similarity between each of the plurality of waveforms and the driving waveform tc by comparing each of the plurality of waveforms and the driving waveform tc, detect a waveform having a similarity equal to or greater than a preset reference similarity from among the plurality of waveforms (B3), and determine the control pattern based on the detected similar waveform (B4).

That is, the control module 32 may compare the plurality of waveforms and the driving waveform tc, and determine the control pattern based on a waveform similar to the driving waveform tc from among the plurality of waveforms (B4).

The preset reference similarity may be a reference value expressed by percentage (%), which is used to detect a waveform similar to the driving waveform tc from among the plurality of waveforms, and, the preset reference similarity may be set, for example, to 90%.

Following is an example of detecting the similar waveform. In the case where the control module 32 compares each of the plurality of waveforms (a) to (f) illustrated in FIG. 4 and the driving waveform tc illustrated in FIG. 6, suppose that a waveform (d) has a similarity of 95% with respect to the driving waveform tc, a waveform (b) has a similarity of 80%, a waveform (d) has a similarity 70%, waveforms (e) and (f) have a similarity of 40%, and a waveform (a) has a similarity of 20%. In this case, the waveform (c), which has a similarity equal to or greater than the preset reference similarity of 90% with respect to the driving waveform tc from among the plurality of waveforms, may be detected as the similar waveform (B2).

The control module 32 may determine the control pattern based on driving information corresponding to the similar waveform (B4).

The control module 32 may determine the control pattern (B4) on the basis of a driving condition, a driving speed, a driving pattern, and a driving result of a driving record corresponding to the similar pattern.

For example, the control module 32 may determine a status of the laundry on the basis of the driving condition, the driving speed, the driving pattern, and the driving result of the driving record corresponding to the similar waveform, and determine the driving speed and the driving pattern corresponding to the similar pattern as the control pattern (B4), such that the washing cycle is performed in accordance with the status of the laundry.

That is, by determining the driving speed and the driving pattern corresponding to the similar waveform similar to the driving waveform tc, the control module 32 may determine a status of the laundry and control driving of the motor part 20 in accordance with the status of the laundry.

The control module 32 may determine a waveform having a similarity equal to or greater than a preset reference similarity with respect to the driving waveform tc from among the plurality of waveforms (B3), and determine the control pattern on the basis of the detected similar waveform (B4). In this case, when there is a plurality of waveforms each having a similarity equal to or greater than the preset reference similarity with respect to the driving waveform tc, the control module 32 may detect the plurality of waveforms as the similar waveform (B3).

That is, the control module 32 may detect one or more waveforms each having a similarity equal to or greater than the preset reference similarity with respect to the driving waveform tc from among the plurality of waveforms (B2).

When the similar waveform is a plurality of waveforms, the control module 32 may determine a driving pattern corresponding to a waveform having the highest driving result from among the plurality of similar waveforms as the control pattern (B4).

That is, by determining a driving pattern corresponding to a waveform having the highest driving result from among the plurality of similar waveforms similar to the driving waveform tc as the control pattern, the control module 32 may determine a control pattern which ensures a maximum performance of the washing (B4).

In addition, by analyzing a washing condition for the laundry on the basis of a driving condition and a driving result corresponding to the similar waveform, the control module 32 may determine the control pattern in accordance with the washing condition (B4).

The washing condition may be a condition relating to one or more of a quantity and a quality of the laundry.

That is, by analyzing the washing condition relating to one or more of a quantity and a quality of the laundry in accordance with the driving condition and the driving result corresponding to the similar waveform, the control module 32 may determine the control pattern in accordance with the washing condition (B4).

The control module 32 may determine one or more patterns in accordance with the washing condition on the basis of the driving condition, determine, on the basis of the driving result, one of the determined one or more patterns as a pattern which ensures a maximum performance of the washing cycle, and determine the determined pattern as the control pattern (B4).

In other words, the control module 32 may determine the washing condition and one or more patterns in accordance with the washing condition on the basis of the driving condition corresponding to the similar waveform, select a pattern having the highest driving result from among the determined one or more patterns on the basis of the driving result corresponding to the similar waveform, and determine the selected pattern as the control pattern (B4).

In addition, the control module 32 may divide the driving waveform Tc into a plurality of sections, compare each of the plurality of sections with each of the plurality of waveforms, detect a waveform having a similarity equal to or greater than the reference similarity with respect to the plurality of sections from among the plurality of waveforms (B3), and determine the control pattern on the basis of the detected similar waveform (B4).

In other words, the control module 32 may divide the driving waveform Tc as illustrated in FIG. 6 into a plurality of sections on an hourly basis, detect a similar waveform for each of the plurality of sections by comparing the plurality of sections with the plurality of waveforms, and determine the control pattern (B4) by aggregating and analyzing driving conditions and results corresponding to similar waveforms respectively detected for the plurality of sections.

FIG. 7 illustrates a concept of the above-described determination procedure which may include: determining a similarity (N1) by comparing a plurality of detection points in the driving waveform tc with the driving waveform tc of the driving information corresponding to pre-stored data, determining the washing condition and a washing cycle in accordance with the washing condition on the basis of the determined similarity and a driving condition of the driving information (N2), and determining a control pattern of the motor part 20 (N3) by assessing a washing performance in accordance with the washing cycle on the basis of a driving result of the driving information.

As such, by detecting a waveform similar to the driving waveform tc from among the plurality of waveforms and determining the control pattern (B4) on the basis of a driving condition, a driving speed, a driving pattern, a driving waveform, and a driving result corresponding to the similar waveform, the control module 32 may control the motor part 20 such that the washing condition and the washing cycle in accordance with the washing condition are determined and performed accurately and properly and the washing cycle is performed with a maximum performance.

That is, by determining accurate and appropriate washing condition and washing cycle on the basis of previous driving records of the motor part 20 and accordingly determining the control pattern (B4), the control device 30 may control driving of the motor part 20 (B5).

By analyzing a control result of the motor part 20 in accordance with the control pattern and storing an analysis result in the driving information, the control module 32 may update the driving information.

Here, the analysis result may include information on a driving condition, a driving speed, a driving pattern, a driving waveform, and a driving result of the motor part 20 in accordance with the control pattern.

That is, the control module 32 analyzes a control result of the motor part 20 and storing an analysis result in the driving information, and accordingly, the control module 32 may update the driving information by adding a driving record of the motor part 20 in accordance with the control result to the driving information.

As such, the driving information may be updated in a manner in which the control module 32 adds a driving record of the motor part 20 in accordance with the control result to the driving information, and thus, the control result may be utilized as comparable data to control the motor part 20, and deep-learning control of the motor part 20 may be performed accordingly.

Hereinafter, a laundry treating apparatus disclosed in the present disclosure will be described with reference to FIG. 8. However, any description redundant with the above description may be omitted, and description necessary to explain how to implement the laundry treating apparatus may be referred to again to explain primarily how to implement the laundry treating apparatus.

The laundry treating apparatus disclosed in the present disclosure refers to a laundry treating apparatus described as above.

The laundry treating apparatus may be a laundry treating apparatus subject to be controlled by the above-described control device 30.

That is, the laundry treating apparatus may be the laundry treating apparatus for the control device 30.

As illustrated in FIG. 8, a laundry treating apparatus 100 includes a washing part 10 for performing a washing cycle with respect to loaded laundry, a motor part 20 for driving the washing part 10 in accordance with the washing cycle, and a controller 30 for storing driving information including information on driving conditions, driving speeds, driving waveforms, and driving results according to driving records of the motor part 20 and for driving the motor part 20 in accordance with the washing cycle.

Here, the controller 30 may be the above-described control device 30.

The laundry treating apparatus 100 may be in a structure identical to the structure illustrated in FIG. 1.

The controller 30 in the laundry treating apparatus 100 may perform test driving of the motor part 20 before the washing cycle, detect a driving waveform of the motor part 20 in accordance with the test driving, determine a control pattern for controlling the motor part 20 on the basis of a result of comparison between the pre-stored driving information and the driving waveform, and drive the motor part 20 in accordance with the control pattern.

As illustrated in FIG. 2, the controller 30 may include a storage module 31 and a control module 32. The storage module 31 is used to store the driving information including information on driving conditions, driving speeds, driving patterns, driving waveforms, and driving results according to driving records of the motor part 20. The control module 32 is used to detect a driving waveform of the motor part 20 by performing test driving of the motor part 20 before the washing cycle, determine a control pattern, based on a result of comparison between the driving information and the driving waveform, a control pattern which ensures a maximum performance of the washing cycle, and control the motor part 20 in accordance with the control pattern.

Here, the driving information may be information (data) about accumulated and stored previous driving records of the motor part 20.

In the driving information, driving records in accordance with previous washing cycles of the motor part 20 may be stored in a table format.

When the laundry is loaded into the washing part 10, the controller 30 may control driving of the motor part 20 such that the washing cycle is performed in accordance with the status of the laundry loaded in the washing part.

Control of the motor part 20 by the controller 30 may be performed in an order illustrated in FIG. 5.

As illustrated in FIG. 5, the control module 32 may perform test driving of the motor part 20 before the washing cycle (B1), detect a driving waveform of the motor part 20 in accordance with the test driving (B2), compare the driving information pre-stored in the storage module 31 and the driving waveform (B3), determine, based on a result of the comparison, a control pattern which ensures a maximum the washing cycle (B4), and control the motor part 20 in accordance with the control pattern (B5).

The test driving may be a test driving for detecting and determining a status of the laundry before the washing cycle.

The test driving may be a test driving for driving the motor part 20 in a preset driving pattern.

The test driving may be a test driving for detecting and determining a status of the laundry on the basis of a result of driving the motor part 20, determining the control pattern based on the detection and determination, and controlling the motor part 20 in accordance with the control pattern.

The control pattern may be a control pattern of the motor part 20 for performing the washing cycle in accordance with a status of the laundry.

The control pattern may be a pattern for controlling one or more of a driving speed, a driving direction, and a driving time of the motor part 20 in accordance with the washing cycle.

The controller 30 may perform test driving of the motor part 20 (B1), and detect the driving waveform in accordance with the test driving (B2) by detecting a change in the speed of the motor part 20 during the test driving.

The driving waveform tc is a waveform in accordance with a change in the driving speed and pattern of the motor part 20, and may be the same as illustrated in FIG. 6.

The controller 30 may detect the driving waveform tc as illustrated in FIG. 6 (B2), and compare the driving information pre-stored in the storage module 31 and the driving waveform tc (B3).

The controller 30 may compare a plurality of waveforms included in the driving information and the driving waveform tc (B3), and determine the control pattern (B4).

The controller 30 may measure a similarity between each of the plurality of waveforms and the driving waveform tc by comparing the plurality of waveforms and the driving waveform tc, detect a waveform having a similarity equal to or greater than a preset reference similarity with respect to the driving waveform tc from among the plurality of waveforms (B3), and determine the control pattern on the basis of the detected similar waveform (B4).

That is, by comparing the plurality of waveforms and the driving waveform tc, the controller 30 may determine the control pattern (B4) on the basis of a waveform similar to the driving waveform tc from among the plurality of waveforms.

The controller 30 may determine the control pattern (B4) on the basis of driving information corresponding to the similar waveform.

The controller 30 may determine the control pattern (B4) on the basis of a driving condition, a driving speed, a driving pattern, and a driving result corresponding to a driving record corresponding to the similar waveform.

For example, by determining a status of the laundry on the basis of the driving condition, the driving speed, the driving pattern, and the driving result of the driving record corresponding to the similar waveform, the controller 30 may determine the driving speed and pattern as the control pattern (B4), such that the washing cycle is performed in accordance with the status of the laundry.

That is, by determining the driving speed and the driving pattern corresponding to the similar waveform similar to the driving waveform tc as the control pattern, the controller 30 may determine a status of the laundry and control driving of the motor part 20 in accordance with the determined status of the laundry.

The controller 30 may detect a waveform having a similarity equal to or greater than a reset reference similarity with respect to the driving waveform tc from among the plurality of waveforms (B3), and determine the control pattern on the basis of the detected similar waveform (B4). In this case, when there is a plurality of waveforms each having a similarity equal to or greater than the preset reference similarity with respect to the driving waveform tc, the controller 30 may detect the plurality of waveforms as the similar waveform (B3).

That is, the controller 30 may detect one or more waveforms each having a similarity equal to or greater than the preset reference similarity with respect to the driving waveform tc from among the plurality of waveforms (B2).

When the similar waveform is a plurality of waveforms, the controller 30 may determine a driving pattern corresponding to a waveform having the highest driving result from among the plurality of similar waveforms as the control pattern (B4).

That is, by determining a driving pattern corresponding to a waveform having the highest driving result from among the plurality of similar waveforms similar to the driving form tc as the control pattern, the controller 30 may determine a control pattern which ensures a maximum performance of the washing cycle (B4).

In addition, by analyzing a washing condition for the laundry on the basis of a driving condition and a driving result corresponding to the similar waveform, the controller 30 may determine the control pattern (B4) in accordance with the washing condition.

The washing condition may be a condition relating to one or more of a quantity and a quality of the laundry.

That is, by analyzing the washing condition relating to one or more of a quantity and a quality of the laundry in accordance with the driving condition and the driving result corresponding to the similar waveform, the controller 30 may determine the control pattern (B4) in accordance with the washing condition.

The controller 30 may determine one or more patterns in accordance with the washing condition on the basis of the driving condition, determine, on the basis of the driving result, one of the determined one or more patterns as a pattern which ensures a maximum performance of the washing cycle, and determine the determined pattern as the control pattern (B4).

In other words, the controller 30 may determine the washing condition and one or more patterns in accordance with the washing condition on the basis of the driving condition corresponding to the similar waveform, select a pattern having the highest driving result from among the determined one or more patterns on the basis of the driving results corresponding to the similar waveform, and determine the selected pattern as the control pattern (B4).

The controller 30 may divide the driving waveform tc into a plurality of sections, compare the plurality of sections with the plurality of waveforms, detect a waveform having a similarity equal to or greater than the reference similarity with respect to the plurality of sections from among the plurality of waveforms (B3), and determine the control pattern on the basis of the detected similar waveform (B4).

In other words, the controller 30 may divide the driving waveform tc as illustrated in FIG. 6 into a plurality of sections on an hourly basis, detect a similar waveform for each of the plurality of sections by respectively comparing the plurality of sections with the plurality of waveforms, and determine the control pattern (B4) by aggregating and analyzing driving conditions and results corresponding to similar waveforms respectively detected for the plurality of sections.

As such, by detecting a waveform similar to the driving waveform tc from among the plurality of waveforms and determining the control pattern (B4) on the basis of a driving condition, a driving speed, a driving pattern, a driving waveform, and a driving result corresponding to the similar waveform, the control module 32 may control the motor part 20 (B5) such that the washing condition and the washing cycle in accordance with the washing condition are determined and performed accurately and properly and the washing cycle is performed with a maximum performance.

That is, by determining accurate and inappropriate washing condition and washing cycle on the basis of previous driving records of the motor part 20 and accordingly determining the control pattern (B4), the controller 30 may control driving of the motor part 20 (B5).

By analyzing a control result of the motor part 20 in accordance with the control pattern and storing an analysis result in the driving information, the controller 30 may update the driving information.

Here, the analysis result may include information on a driving condition, a driving speed, a driving pattern, a driving waveform, and a driving result of the motor part 20 in accordance with the control pattern.

That is, the controller 30 analyzes the control result of the motor part 20 and storing an analysis result in the driving information, and accordingly, the controller 30 may update the driving information by adding a driving record of the motor part 20 in accordance with the control result to the driving information.

As such, the driving information may be updated in a manner in which the controller 30 adds the driving record of the motor part 20 in accordance with the control result to the driving information, and thus, the control result may be utilized as comparable data to control the motor part 20 and deep-learning control of the motor part 20 may be performed accordingly.

Hereinafter, a control method of an laundry treating apparatus disclosed in the present disclosure will be described with reference to FIGS. 9 and 10. However, any description redundant with the above description may be omitted, and description necessary to explain how to implement a control method of the laundry treating apparatus may be referred to again to explain primarily how to implement the control method of the laundry treating apparatus.

A control method of a laundry treating apparatus disclosed in the present disclosure (hereinafter, referred to as a control method) is a control method of a laundry treating apparatus 100 which, as illustrated in FIGS. 2 to 8, includes: a washing part 10 for performing a washing cycle with respect to loaded laundry; and a motor part 20 for driving the washing part 10 in accordance with the washing cycle. The control method may be a method for controlling the above-described control device 30, or a method for controlling the above-described laundry treating apparatus 100.

That is, the control method may be a control method applicable to the above-described control device 30 or the controller 30 of the above-described laundry treating apparatus 100.

As illustrated in FIG. 9, the control method may include step S10 of detecting a driving waveform by performing test driving of the motor part 20, step S20 of determining a control pattern to control the motor part 20 by comparing pre-stored driving information and the driving waveform, and step S30 of performing the washing cycle by controlling the motor part 20 in accordance with the control pattern.

Here, the driving information may include information on driving conditions, driving speeds, driving patterns, driving waveforms, and driving results according to driving records of the motor part 20.

The driving information may be information (data) about accumulated and stored previous driving records of the motor part 20.

In the driving information, driving records in accordance with previous washing cycles of the motor part 20 may be stored in a table format.

In the step S10, test driving of the motor part 20 may be performed in a preset driving pattern.

The test driving may be a test driving for detecting and determining a status of the laundry before the washing cycle.

The test driving may be a test driving for driving the motor part 20 in a preset driving pattern.

The test driving may be a test driving for detecting and determining a status of the laundry on the basis of a result of driving the motor part 20, determining the control pattern based on the detection and determination, and controlling the motor part 20 in accordance with the control pattern.

The control pattern may be a control pattern of the motor part 20 for performing the washing cycle in accordance with a status of the laundry.

The control pattern may be a pattern for controlling a change in one or more of a driving speed, a driving direction, and a driving time of the motor part 20 in accordance with the washing cycle.

In the step S10, test driving of the motor part 20 may be performed in the preset driving pattern, and the driving waveform in accordance with the test driving may be detected.

In the step S10, test driving of the motor part 20 may be performed, a change in speed of the motor part 20 may be detected during the test driving, and the driving waveform in accordance with the test driving may be detected.

The driving waveform tc is a waveform in accordance with a change in a driving speed and a driving pattern of the motor part 20, and may be the same as illustrated in FIG. 6.

In the step S20, the control pattern may be determined by comparing the driving waveform tc detected in the step S10 and the driving information.

As illustrated in FIG. 10, the step S20 may include: step S21 of comparing a plurality of waveforms included in the driving information and the driving waveform tc; step S22 of measuring a similarity between each of the plurality of waveforms and the driving waveform tc; step S23 of detecting a waveform having a similarity equal to or greater than a preset reference similarity with respect to the driving waveform tc from among the plurality of waveforms; and step S24 of determining the control pattern on the basis of detected similar waveform.

That is, in the step S20, the plurality of waveforms and the driving waveform tc may be compared, and the control pattern may be determined on the basis of a waveform that is similar to the driving waveform tc from among the plurality of waveforms.

In the step S23, when there is a plurality of waveforms each having a similarity equal to or greater than the preset reference similarity with respect to the driving waveform tc, the plurality of waveforms may be detected as the similar waveform.

In the step S24, the control pattern may be determined on the basis of driving information corresponding to the similar waveform.

In the step S24, the control pattern may be determined on the basis of a driving condition, a driving speed, a driving pattern, and a driving result of a driving record corresponding to the similar waveform.

For example, a status of the laundry may be determined on the basis of the driving condition, the driving speed, the driving pattern, and the driving result of the driving record corresponding to the similar waveform, and the driving speed and the driving pattern corresponding to the similar waveform may be determined as the control pattern, such that the washing cycle is performed in accordance with the status of the laundry.

That is, in step S24, the driving speed and the driving pattern corresponding to the similar waveform similar to the driving waveform tc may be determined as the control pattern.

In the step S24, when a plurality of similar waveforms is detected as the similar waveform in the step S23, a driving pattern corresponding to a waveform having the highest driving result from among the plurality of similar waveforms may be determined as the control pattern.

That is, in step S24, as a driving pattern corresponding to a waveform having the highest driving result from among the plurality of similar waveforms similar to the driving waveform tc is determined as the control pattern, a control pattern ensuring a maximum performance of the washing cycle may be determined.

In the step S24, as a washing condition for the laundry is analyzed on the basis of the driving condition and result corresponding to the similar waveform, the control pattern may be determined in accordance with the washing condition.

The washing condition may be a condition relating to one or more of a quantity and a quality of the laundry.

That is, in the step S24, as the washing condition relating to one or more of a quantity and a quality of the laundry is analyzed in accordance with the driving condition and result corresponding to the similar waveform, the control pattern may be determined in accordance with the washing condition.

In the step S24, one or more patterns may be determined in accordance with the washing condition on the basis of the driving condition, a pattern which ensures a maximum performance of the washing cycle may be determined from among the one or more patterns on the basis of the driving result, and the determined pattern may be determined as the control pattern.

In other words, the washing condition and one or more patterns in accordance with the washing condition may be determined on the basis of the driving condition corresponding to the similar waveform, a pattern having the highest driving result may be selected from the one or more patterns on the basis of the driving condition corresponding to the similar waveform, and the selected pattern may be determined as the control pattern.

In the step S24, the driving waveform tc may be divided into a plurality of sections, the plurality of sections and the plurality of waveforms may be compared, a waveform having a similarity equal to or greater than the reference similarity with respect to the plurality of sections may be detected from among the plurality of waveforms, and the control pattern may be determined on the basis of the detected similar waveform.

In the step S30, the washing cycle may be performed by controlling the motor part 20 in accordance with the control pattern determined in the step S20.

As described above, the control method including the step S10 of detecting the waveform tc, the step S20 of determining the control pattern on the basis of the driving waveform tc and the driving information, and the step S30 of performing the washing cycle by controlling the motor part 20 in accordance with the control pattern may further include step S40 of analyzing a control result of the motor part 20 in accordance with the control pattern and storing an analysis result in the driving information.

The analysis result may include a driving condition, a driving speed, a driving pattern, a driving waveform, and a driving result of the motor part 20 in accordance with the control pattern.

That is, the control method includes analyzing control result of the motor part 20 and storing an analysis result in the driving information, and thus, the driving information may be updated by adding a driving record of the motor part 20 in accordance with the control result to the driving information.

As such, as the driving information is updated by adding the driving record of the motor part 20 in accordance with the control result to the driving information, the control result may be utilized as comparable data to control the motor part 20 and deep-learning control of the motor part 20 may be implemented accordingly.

The laundry treating apparatus and the control method thereof disclosed in the present invention are characterized in that test driving of a motor part for driving a washing part is performed, a control pattern is determined on the basis of a result of the test driving, and the motor part is controlled in accordance with the control pattern, and thus, there are advantages in that a washing condition may be determined without an additional detection means and a washing cycle may be performed in accordance with the washing condition.

In addition, the laundry treating apparatus and the control method thereof disclosed in the present invention are characterized in that the driving waveform in accordance with the test driving is analyzed on the basis of pre-stored data (driving information) and driving of the motor part is controlled in accordance with the control pattern determined based on a result of the determination, and thus, there are advantages in that an appropriate control pattern may be determined and controlled on the basis of accumulated information and learning control may be performed such that a control result is reflected in the accumulated information.

Accordingly, the laundry treating apparatus and the control method thereof disclosed in the present invention are characterized in that a washing condition is determined and a washing cycle is performed in accordance with the washing condition, and thus, there are advantages in that a washing performance may be maximized and an appropriate washing operation may be performed in accordance with the washing condition, and furthermore, the washing performance may be enhanced in proportion to the number of times a washing cycle is performed.

In addition, the laundry treating apparatus and the control method thereof disclosed in the present invention are characterized in that a washing performance is enhanced in proportion to the number of times a washing cycle is performed, and thus, there is advantages in that the washing performance may be enhanced and maintained easily and reliability of the washing cycle may improve.

According to the above embodiments, the laundry treating apparatus and the control method thereof disclosed in the present invention are characterized in that test driving of the motor part for the washing part is performed, a control pattern is determined on the basis of a result of the test driving, and the motor part is controlled in accordance with the control pattern, and thus, there are advantages in that a washing condition may be determine without an additional detection means and a washing cycle may be performed in accordance with the washing condition. An appropriate control pattern may be determined and controlled on the basis of accumulated information, and learning control may be performed such that a control result is reflected in the accumulated information. Washing performance may be maximized and appropriate washing in accordance with the washing condition may be performed, and furthermore, the washing performance may be enhanced in proportion to the number of times the washing cycle is performed. Accordingly, the limitations of the conventional technology may be overcome and the objects of the present invention may be solved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A control device of a laundry treating apparatus that includes a washing part configured to perform a washing cycle and a motor part configured to drive the washing part according to the washing cycle, the control device comprising:

a storage module configured to store driving information that includes driving conditions, driving speeds of the motor part, driving waveforms of the motor part corresponding to the driving conditions, and performance results according to the driving waveforms of the motor part, wherein the driving waveforms are defined based on changes of revolutions per minute (RPM) of the motor part during one or more washing cycles, and the performance results include performance result scores that are determined after the one or more washing cycles based on at least one of power consumed during the one or more washing cycles, a total time spent for the one or more washing cycles, an amount of water consumed during the one or more washing cycles, and a degree of washing of laundry; and a control module configured to:

perform a test drive of the motor part, detect a driving waveform of the motor part based on a change of the RPM of the motor part during the test drive, compare the driving waveform detected during the test drive to the driving waveforms included in the driving information, determine a similarity level between each of the driving waveforms included in the driving information and the driving waveform detected during the test drive, identify a plurality of target waveforms among the driving waveforms included in the driving information, the plurality of target waveforms having the similarity level that is greater than or equal to a reference similarity level, determine a target waveform among the plurality of target waveforms, the target waveform having a highest performance result score among the performance result scores, and control the motor part to perform the washing cycle based on the target waveform.

2. The control device of claim 1, wherein the control module is further configured to perform the test drive based on a predetermined driving waveform.

3. The control device of claim 1, wherein the control module is further configured to determine the target waveform to control a change in at least one of a driving speed, a driving direction, or a driving time of the motor part based on the washing cycle.

4. The control device of claim 1, wherein the control module is further configured to:

determine (i) a target driving condition among the driving conditions, (ii) a target driving speed among the driving speeds, and (iii) a target performance result among the performance results.

5. The control device of claim 4, wherein the control module is further configured to:

determine a washing condition corresponding to the target driving condition and the target driving performance result.

6. The control device of claim 5, wherein the washing condition comprises a condition related to at least one of a quantity of laundry or a quality of laundry.

7. The control device of claim 1, the control module is further configured to:

after the washing cycle performed based on the target waveform, determine result information comprising a driving condition, a driving speed, a driving pattern, a driving waveform, a performance result, and a performance result score corresponding to the washing cycle; and update the driving information by storing the result information in the driving information.

8. The control device of claim 1, wherein the control module is configured to:

update the driving information to include the driving waveform detected during the test drive in the driving waveforms.

9. The control device of claim 1, wherein the reference similarity level is a preset number.

10. The control device of claim 9, wherein the control module is configured to compare the similarity level corresponding to each of the driving waveforms included in the driving information to the reference similarity level to thereby identify the plurality of target waveforms among the driving waveforms included in the driving information.

11. A laundry treating apparatus comprising:

a washing part configured to perform a washing cycle;

a motor part configured to drive the washing part according to the washing cycle; and a controller configured to:

store driving information that includes driving conditions, driving speeds of the motor part, driving waveforms of the motor part corresponding to the driving conditions, and performance results according to driving waveforms of the motor part, wherein the driving waveforms are defined based on changes of revolutions per minute (RPM) of the motor part during one or more washing cycles, and the performance results include performance result scores that are determined after the one or more washing cycles based on at least one of power consumed during the one or more washing cycles, a total time spent for the one or more washing cycles, an amount of water consumed during the one or more washing cycles, and a degree of washing of laundry, perform a test drive of the motor part, detect a driving waveform of the motor part defined based on a change of the RPM of the motor part during the test drive, compare the driving waveform detected during the test drive to the driving waveforms included in the driving information, determine a similarity level between each of the driving waveforms included in the driving information and the driving waveform detected during the test drive, identify a plurality of target waveforms among the driving waveforms included in the driving information, the plurality of target waveforms having the similarity level that is greater than or equal to a reference similarity level, determine a target waveform among the plurality of target waveforms, the target waveform having a highest performance result score among the performance result scores, and control the motor part to perform the washing cycle based on the target waveform.

12. The laundry treating apparatus of claim 11, wherein the controller is further configured to:

determine (i) a target driving condition among the driving conditions, (ii) a target driving speed among the driving speeds, and (iii) a target performance result among the performance results.

13. The laundry treating apparatus of claim 12, wherein the controller is further configured to:

determine a washing condition corresponding to the target driving condition and the target performance result.

14. The laundry treating apparatus of claim 11, wherein the controller is further configured to:

after the washing cycle performed based on the target waveform, determine result information comprising a driving condition, a driving speed, a driving waveform, a performance result, and a performance result score corresponding to the washing cycle; and update the driving information by storing the result information in the driving information.

15. The laundry treating apparatus of claim 11, wherein the controller is further configured to:

update the driving information to include the driving waveform detected during the test drive in the driving waveforms.

16. A control method of a laundry treating apparatus that includes a washing part configured to perform a washing cycle and a motor part configured to drive the washing part according to the washing cycle, the control method comprising:

performing a test drive of the motor part;

detecting a driving waveform of the motor part, the driving waveform being defined based on a change of revolutions per minute (RPM) of the motor part during the test drive;

comparing the driving waveform detected during the test drive to driving waveforms included in pre-stored driving information that includes driving conditions, driving speeds of the motor part, the driving waveforms corresponding to the driving conditions, and performance results according to the driving waveforms of the motor part, wherein the driving waveforms are defined based on changes of the RPM of the motor part during one or more washing cycles, and the performance results include performance result scores that are determined after the one or more washing cycles based on at least one of power consumed during the one or more washing cycles, a total time spent for the one or more washing cycles, an amount of water consumed during the one or more washing cycles, and a degree of washing of laundry;

determining a similarity level between each of the driving waveforms included in the pre-stored driving information and the driving waveform corresponding to the test drive;

identifying a plurality of target waveforms among the driving waveforms included in the pre-stored driving information, the plurality of target waveforms having the similarity level that is greater than or equal to a reference similarity level;

determining a target waveform among the plurality of target waveforms, the target waveform having a highest performance result score among the performance result scores; and controlling the motor part to perform the washing cycle based on the target waveform.

17. The control method of claim 16, wherein determining the target waveform comprises:

determining (i) a target driving condition among the driving conditions, (ii) a target driving speed among the driving speeds, and (iii) a target performance result among the performance results.

18. The control method of claim 16, further comprising:

updating the pre-stored driving information to include the driving waveform detected during the test drive in the driving waveforms.

19. The control method of claim 16, further comprising:

after performing the washing cycle based on the target waveform, determining result information comprising a driving condition, a driving speed, a driving waveform, a performance result, and a performance result score corresponding to the washing cycle; and updating the driving information by storing the result information in the pre-stored driving information.

* * * * *